US007232166B2

(12) United States Patent
Dukate et al.

(10) Patent No.: US 7,232,166 B2
(45) Date of Patent: Jun. 19, 2007

(54) VARIABLE WIRE ROPE BRAKE ASSEMBLY

(75) Inventors: Darrell E Dukate, Florissant, MO (US); Louis F. Murray, Eureka, MO (US); Kenneth E. Sherer, Bethalto, IL (US)

(73) Assignee: The Boeing Company, Chicago, IL (US)

( * ) Notice: Subject to any disclaimer, the term of this patent is extended or adjusted under 35 U.S.C. 154(b) by 7 days.

(21) Appl. No.: 11/236,913

(22) Filed: Sep. 28, 2005

(65) Prior Publication Data

US 2007/0069538 A1 Mar. 29, 2007

(51) Int. Cl.
*B66C 1/12* (2006.01)

(52) U.S. Cl. ..... 294/82.12; 294/74

(58) Field of Classification Search ..... 294/82.11, 294/82.12, 82.16, 81.3, 67.5, 74; 254/390, 254/391, 398, 399, 333, 411; 188/64, 65.1–65.5
See application file for complete search history.

(56) References Cited

U.S. PATENT DOCUMENTS

| | | | | | |
|---|---|---|---|---|---|
| 1,436,608 | A | * | 11/1922 | Rodier | 254/399 |
| 2,973,942 | A | * | 3/1961 | Schaper | 254/399 |
| 3,549,129 | A | * | 12/1970 | Graham et al. | 114/245 |
| 3,709,548 | A | * | 1/1973 | Hogshead | 294/74 |
| 4,084,794 | A | * | 4/1978 | Wallace | 254/399 |
| 4,351,417 | A | * | 9/1982 | Seiz et al. | 187/373 |
| 4,762,355 | A | * | 8/1988 | Hogg | 294/82.12 |

* cited by examiner

*Primary Examiner*—Dean J. Kramer
(74) *Attorney, Agent, or Firm*—Klein, O'Neill & Singh, LLP; Tejinder Singh

(57) ABSTRACT

A hoist assembly and system capable of being adjusted prior to the lifting and transporting of the loads to accommodate infinite center of gravity changes on loads, such that no changes in position occur during the lifting and transporting process.

15 Claims, 4 Drawing Sheets

VARIABLE WIRE ROPE BRAKE ASSEMBLY

FEDERALLY SPONSORED RESEARCH OR DEVELOPMENT

This invention was made with Government support under Contract No. MDA972-99-9-0003 awarded by DARPA. The Government has certain rights in the invention.

BACKGROUND

1. Field of the Invention

This invention relates generally to a mechanism and associated system for stabilizing and controlling a hoisted load.

2. Related Art

Generally, load transporting mechanisms have a single point lifting capability, such as a single lifting cable. The lifting cable is generally stable only in the vertical direction. Under any external influence from the sides, the load may rotate or sway.

Various conventional mechanisms have been developed that are intended to compensate for these motions, and stabilize the hoisted load. Single point hoist mechanisms, for example, typically include a heavy duty hoist mechanism, which may include a winch and block and tackle. However, load movement is a basic problem typical of such mechanisms.

One example of a typical stabilized cargo-handling system uses a means for stabilizing suspended cargo in all six degrees of freedom. These systems have been known to employ at least six individually controlled cables in tension in a kinematic arrangement. Sensors, placed in the complex arrangement with the cables, with high-performance cable drives, are typically used to provide the means to control the multi-cabled system.

While the aforementioned conventional system may provide varying degrees of control of a hoisted load, its complexity causes it to not be easily adapted to existing single point lift mechanisms.

What is needed is a hoist assembly, which is capable of being adjusted to accommodate the lifting and transporting of loads of various sizes and weights.

SUMMARY

The present invention provides a hoist assembly and system for lifting and transporting loads. The present invention is capable of being adjusted prior to the lifting and transporting of the loads to accommodate infinite center of gravity changes on loads, such that no changes in position occur during the lifting and transporting process.

The present invention advantageously relates to a mechanism for stabilizing and controlling the movement of the hoisted load. The mechanism includes scissor like details and sheaves which clamp, brake and/or restrict wire rope movement (slippage) at the time of hoisting a load.

In one aspect of the present invention, a hoist assembly is provided for stabilizing the movement of a hoisted load. The hoist assembly includes an upper pulley; a first lower pulley and a second lower pulley; a pair of upper scissor members; and a pair of lower scissor members. The pair of lower scissor members are in operational arrangement with the pair of upper scissor members to cause the upper pulley to move between an engaged position with the first lower pulley and the second lower pulley and a disengaged position with the first lower pulley and the second lower pulley.

In another aspect of the present invention, a hoist system is provided for stabilizing the movement of a hoisted load. The hoist system includes a hoist assembly including a means for causing an upper pulley to move between an engaged position with a first lower pulley and a second lower pulley and a disengaged position with the first lower pulley and the second lower pulley. The system also includes a rope, such as a continuous rotation resistant wire rope.

Beneficially, the hoist assembly of the present invention provides the ability to stabilize and control a load while it is being lifted or lowered. The hoist assembly is a single point lift mechanism that is relatively light weight, flexible, precise, and easy to operate.

Advantageously, the present invention is equally compatible with various types of lifting means, including but not limited to, boom cranes, overhead bridge gantry-type cranes and tower-type cranes.

Additional advantages, objects, and features of the invention will be set forth in part in the detailed description which follows. It is to be understood that both the foregoing general description and the following detailed description are merely exemplary of the invention, and are intended to provide an overview or framework for understanding the nature and character of the invention as it is claimed.

BRIEF DESCRIPTION OF THE DRAWINGS

The accompanying drawings are included to provide further understanding of the invention, illustrate various embodiments of the invention, and together with the description serve to explain the principles and operation of the invention. In the drawings, the same components have the same reference numerals. The illustrated embodiment is intended to illustrate, but not to limit the invention. The drawings include the following Figures.

DETAILED DESCRIPTION

The motion of a hoisted load may best be described in terms of a Cartesian coordinate system. In describing embodiments of the present invention, the z-axis is in the vertical direction, and the x- and y-axes form the horizontal plane. Terms, such as "lift" and "hoist" as used herein should be understood to refer to lifting, transporting and/or lowering a load, or holding a load stationary in a suspended position.

Figure 1A:
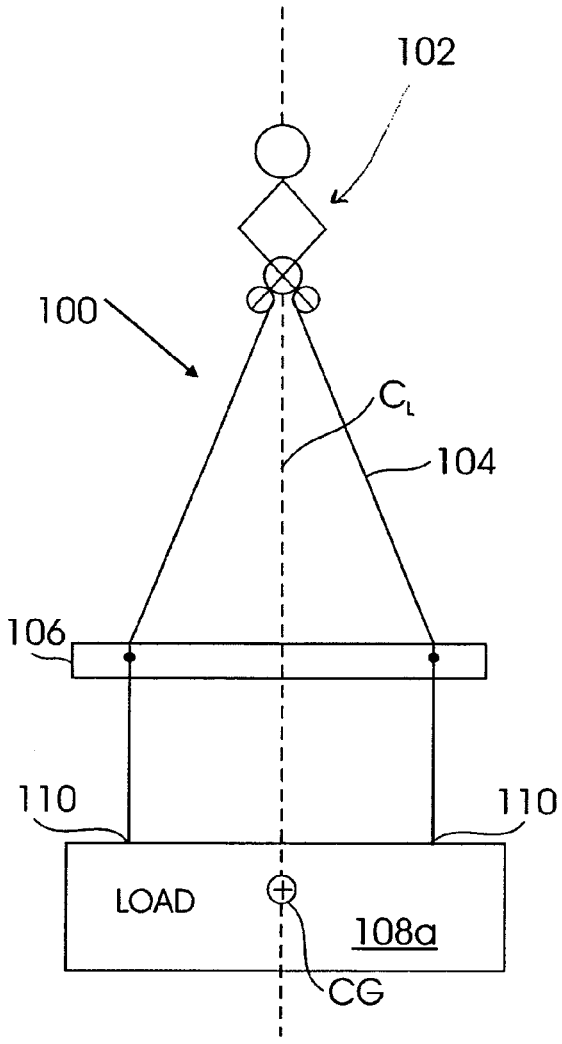
FIGS. 1A and 1B are schematic diagrams of a hoist system using a hoist assembly in accordance with an embodiment of the present invention.
Figure 1B:
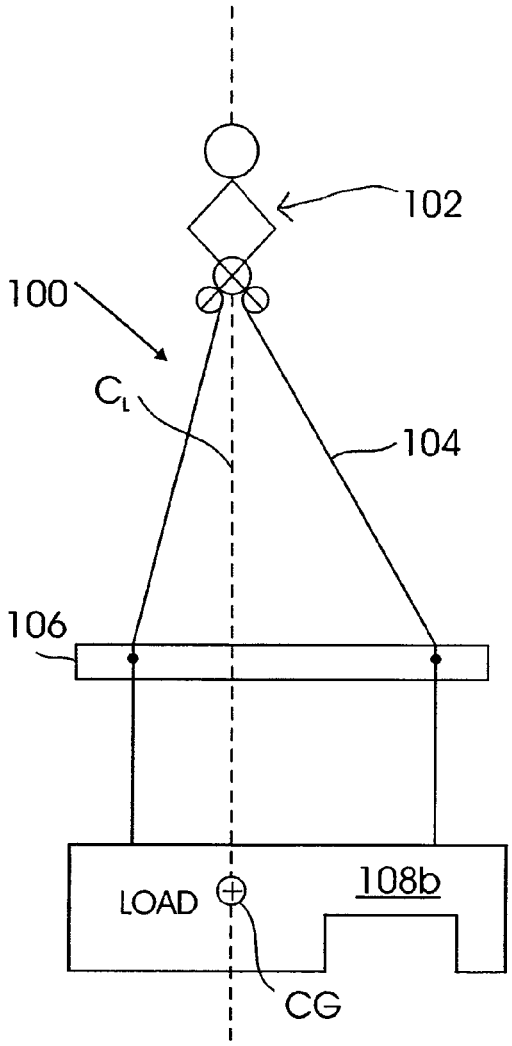

FIGS. 1A and 1B are simplified schematic illustrations of a hoist system 100 shown in accordance with an embodiment of the present invention. In this embodiment, hoist system 100 includes hoist assembly 102 and cable or rope 104, which may be a continuous "rotation resistant" wire rope 104 and the like. In an alternative embodiment, hoist system 100 may also include back spreader beam hoist tool 106 (hereinafter "back spreader 106"), which can be used to distribute pick-up points 110 on the load to positions that provide more stability for loads 108*a* or 108*b*.

As explained in more detail below, in one embodiment, hoist system 100 may be used to lift, hoist and transport loads, such as 108*a* and 108*b*, which are different in that they have centers-of-gravity (CG) which vary relative to one another. To ensure that load 108*a* and load 108*b* are lifted with equal stability, hoist assembly 102 may be "repositioned" as load 108*a* is replaced in the system with load 108*b*.

The repositioning of hoist assembly 102 from one position to another to accommodate the hoisting of different load configurations, such as loads 108*a* and 108*b*, is accomplished by allowing hoist assembly 102 to slide along wire rope 104 until hoist assembly 102 is positioned above the CG of the load to be lifted, thus making hoist system 100 stable. As described in detail below, as the load is then hoisted, hoist assembly 102 is made to lock wire rope 104 in a fixed position.

Figure 2:
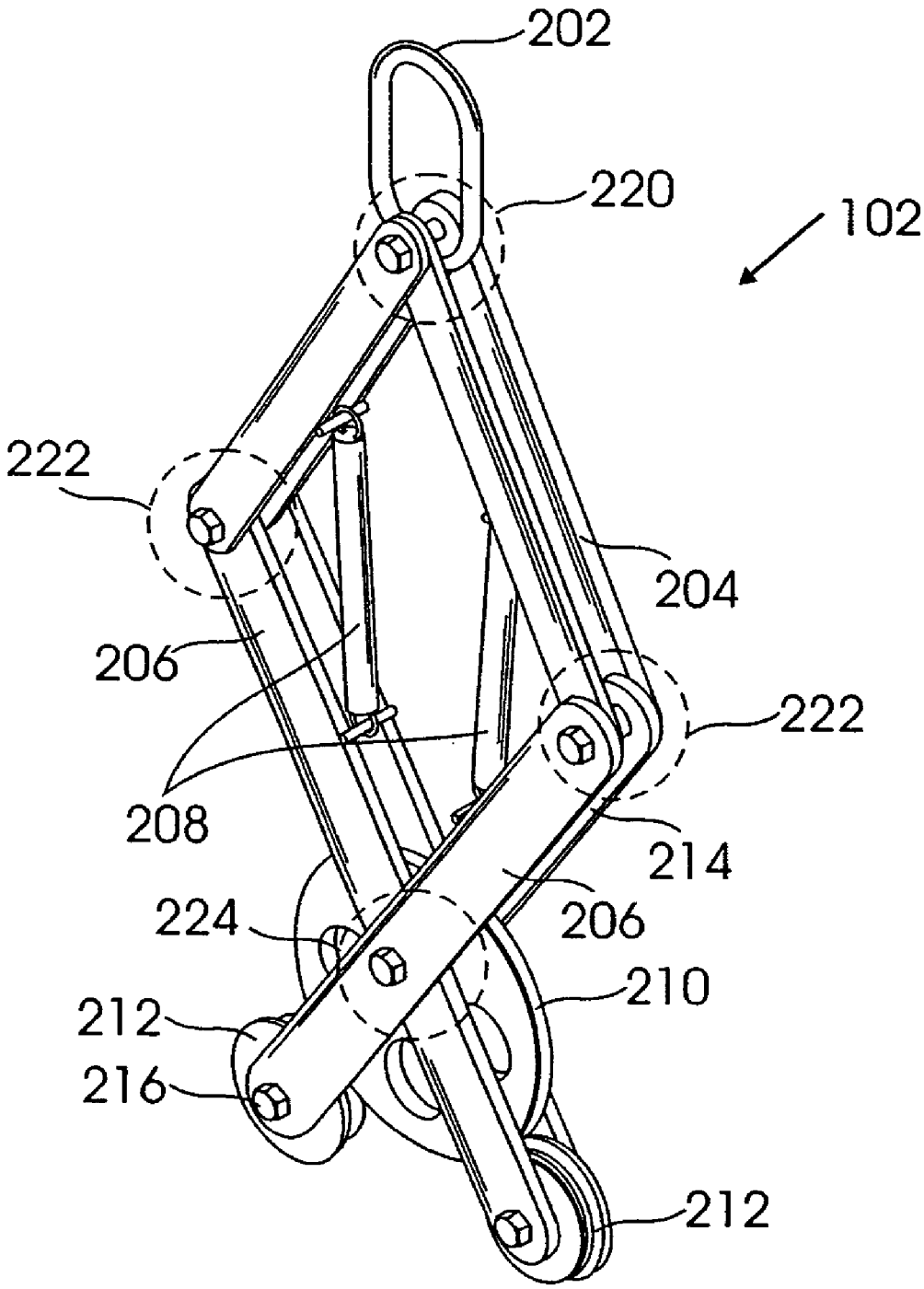
FIG. 2 is a simplified perspective view of a hoist assembly in accordance with an embodiment of the present invention.

FIG. 2 is a simplified perspective view of hoist assembly 102 in accordance with an embodiment of the present invention. In this embodiment, hoist assembly 102 includes a combination of mechanical linkages and pulleys that are linked into a "scissor" type relationship.

In this embodiment, hoist assembly 102 includes hoist link 202, upper scissor members 204, lower scissor members 206, biasing members 208, upper pulley 210, lower pulleys 212 (i.e. pinch rollers) and spacers 214. It should be understood that each of these components is commercially available or may be custom made by machining, casting or milling the parts using conventional manufacturing methods. It should also be understood that the dimensions of the components and their material composition can be varied to accommodate specific hoisting applications and load requirements.

Figure 3A:
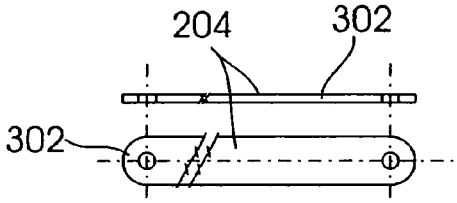
FIGS. 3A–3D are simplified illustrations of components of the hoist assembly embodiment of FIG. 1.
Figure 3B:
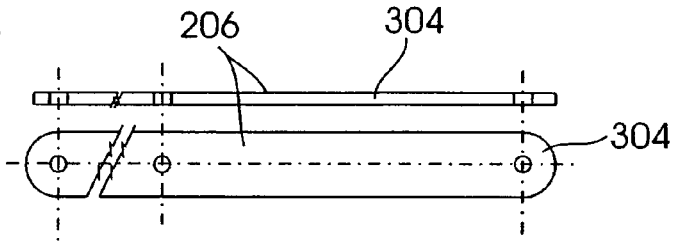

As shown in FIGS. 3A and 3B in combination with FIG. 2, in one embodiment, each scissor member 204 and 206 includes two plates 302 and 304, respectively, which are held together in a parallel relationship with a space therebetween to accommodate pulleys, spacers and the like.

In one embodiment, a first end of each of the two upper scissor members 204 are coupled together at first pivot point 220, using a conventional fastening means, for example, a bolt or rivet, which allow the members to pivot. Hoist link 202, which may include, for example a fastening ring or a hook, can also be arranged secure with hoist assembly 102 at pivot point 220.

A second end of each upper scissor member 204 is coupled to a first end of each lower scissor member 206 at pivot point 222. To ensure adequate space for pulleys and the like to be positioned between plates 304 of lower scissor members 206, a spacer 214 may be sandwiched between the upper and lower scissor members 204 and 206. Any conventional fastening means can be used to fasten the scissor members together, as long as the fastening means allows the scissor members to pivot.

Figure 3C:
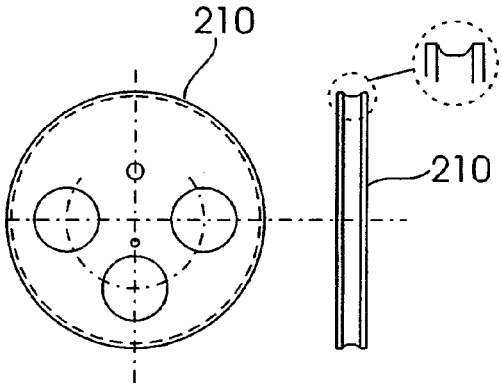
Figure 3D:
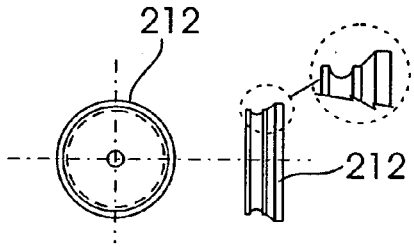

Lower scissor members 206 are coupled together at pivot point 224, using the conventional fastening means. Referring again to FIG. 2 and to FIGS. 3C and 3D, upper pulley 210 is co-located at pivot point 224, and held in a position between plates 304, such that the fastening means couples upper pulley 210 to hoist assembly 102, while also allowing upper pulley 210 to rotate thereabout.

Lower pulleys or pinch rollers 212 are coupled at a second end of each lower scissor member 206, between plates 304. Lower pulleys 212 are positioned on the periphery of upper pulley 210, such that an edge of upper pulley 210 may be made to contact an edge of each lower pulley 212 to be operationally effective.

Figure 4:
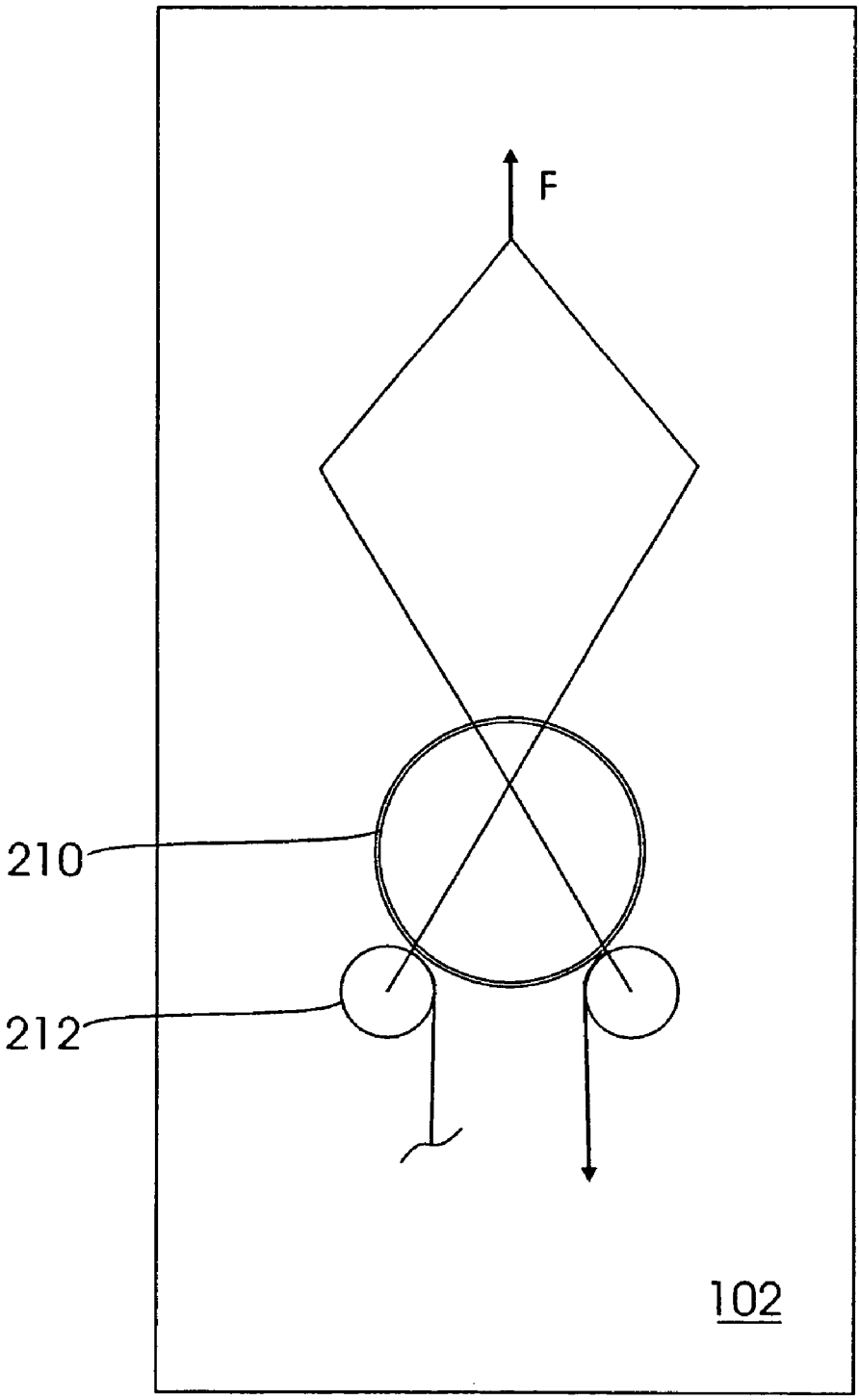
FIG. 4 is a load diagram in accordance with an embodiment of the present invention.

Lower pulleys 212 are biased into position using biasing members 208. In operation, biasing members 208 cause pinch rollers 212 to be biased into position against upper pulley 210 when a load F is placed on hoist assembly 102 (see FIG. 4). The positioning of lower pulleys 212 and upper pulley 210 relative to each other is such that a rope, such as wire rope 104 (FIG. 1A), that may be wrapped about upper pulley 210 is in operational contact with lower pulleys 212. In this manner, lower pulleys 212 can allow the rope to slide around upper pulley 210 during repositioning, but provide a "pinching" effect to hold or lock the rope in place when a load is being hoisted.

Referring again to FIG. 1A, in operation a first load 108*a* is lifted using hoist system 100. With no load applied, the centerline of hoist assembly 102 is positioned above the CG of load 108*a*. In this embodiment, a back spreader 106 is used to spread pick-up points 110 out to a position on the periphery of load 108*a* so as to add to the stability of hoist system 100.

Referring now to FIG. 1B, in this embodiment, it can be assumed that a portion of original load 108*a* has been off-loaded to create second load 108*b*. To bring hoist system 100 into a desired level of stability, with no load applied, wire rope 104 is made to slide around upper pulley 110 until the centerline of hoist assembly 102 is repositioned above the CG of load 108*b*.

To accomplish this, once load F (FIG. 4) is removed from hoist assembly 102, biasing members 208 cause scissor members 204 and 206 to pivot relative to each other by forcing the pivot points 222 apart relative to the centerline C of hoist assembly 102. This movement forces lower pulleys 212 to "disengage" from upper pulley 210 and thus allow wire rope 104 to move freely about upper pulley 210.

Once hoist assembly is positioned directly above the CG of second load 108*b*, load F may be replaced on hoist assembly 102, which overcomes biasing members 208 to cause pivot points 222 to move to a position away from centerline C. This movement forces lower pulleys 212 to "re-engage" wire rope 104 to hold the rope in position during hoisting and to maintain the stability of hoist system 100 with second load 108*b*.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A hoist assembly for stabilizing the movement of a hoisted load, said hoist assembly comprising:

an upper pulley;

a first lower pulley and a second lower pulley;

a pair of upper scissor members; and a pair of lower scissor members, the pair of lower scissor members in operational arrangement with the pair of upper scissor members to cause said upper pulley to move between an engaged position with said first lower pulley and said second lower pulley and a disengaged position with said first lower pulley and said second lower pulley.

2. The hoist assembly of claim 1, further comprising a hoist link.

3. The hoist assembly of claim 2, wherein said hoist link comprises a hook or a fastening ring.

4. The hoist assembly of claim 1, wherein said first lower pulley and said second lower pulley comprise pinch rollers.

5. The hoist assembly of claim 1, further comprising a wire rope configured to wrap around said upper pulley.

6. The hoist assembly of claim 5, wherein said engaged position further comprises said wire rope engaged between said upper pulley and either of said first and said second lower pulleys.

7. The hoist assembly of claim 5, wherein said disengaged position further comprises said wire rope free of engagement between said upper pulley and either of said first and said second lower pulleys.

8. The hoist assembly of claim 1, further comprising biasing members for causing said movement of the upper pulley with the first lower pulley and the second lower pulley to said disengaged position.

9. A hoist assembly for stabilizing the movement of a hoisted load, said hoist assembly comprising:

an upper pulley;

a first lower pulley and a second lower pulley;

means for causing said upper pulley to move between an engaged position with said first lower pulley and said second lower pulley and a disengaged position with said first lower pulley and said second lower pulley; and biasing members for causing said movement of the upper pulley with the first lower pulley and the second lower pulley to said disengaged position.

10. A hoist system for stabilizing the movement of a hoisted load, said hoist system comprising:

a hoist assembly including a means for causing an upper pulley to move between an engaged position with a first lower pulley and a second lower pulley and a disengaged position with said first lower pulley and said second lower pulley; and a rope;

wherein said means comprises: a pair of upper scissor members; and a pair of lower scissor members, the pair of lower scissor members in operational arrangement with the pair of upper scissor members to cause said upper pulley to move between said engaged position with said first lower pulley and said second lower pulley and said disengaged position with said first lower pulley and said second lower pulley.

11. The system of claim 10, wherein said rope comprises a continuous rotation resistant wire rope.

12. The system of claim 10, wherein said engaged position further comprises said rope engaged between said upper pulley and either of said first and said second lower pulleys.

13. The system of claim 10, wherein said disengaged position further comprises said rope free of engagement between said upper pulley and either of said first and said second lower pulleys.

14. The system of claim 10, further comprising biasing members for causing said movement of the upper pulley with the first lower pulley and the second lower pulley to said disengaged position.

15. A hoist system for stabilizing the movement of a hoisted load, said hoist system comprising:

a hoist assembly including a means for causing an upper pulley to move between an engaged position with a first lower pulley and a second lower pulley and a disengaged position with said first lower pulley and said second lower pulley; and a rope;

wherein said first lower pulley and said second lower pulley comprise pinch rollers.

* * * * *